US011420235B2

(12) United States Patent
Gibson

(10) Patent No.: US 11,420,235 B2
(45) Date of Patent: Aug. 23, 2022

(54) POWERED SCRUBBING WAND ASSEMBLY

(71) Applicant: Carlene Gibson, Johnstown, PA (US)

(72) Inventor: Carlene Gibson, Johnstown, PA (US)

( * ) Notice: Subject to any disclaimer, the term of this patent is extended or adjusted under 35 U.S.C. 154(b) by 417 days.

(21) Appl. No.: 16/735,030

(22) Filed: Jan. 6, 2020

(65) Prior Publication Data

US 2021/0205855 A1 Jul. 8, 2021

(51) Int. Cl.

| | |
|---|---|
| ***F21V 33/00*** | (2006.01) |
| ***B08B 1/04*** | (2006.01) |
| ***A46B 13/04*** | (2006.01) |
| ***A46B 15/00*** | (2006.01) |
| ***F21V 23/04*** | (2006.01) |
| ***F21L 4/00*** | (2006.01) |
| ***B08B 3/08*** | (2006.01) |

(52) U.S. Cl.

CPC ..... *B08B 1/04* (2013.01); *A46B 13/04* (2013.01); *A46B 15/0036* (2013.01); *B08B 3/08* (2013.01); *F21L 4/00* (2013.01); *F21V 23/0414* (2013.01); *F21V 33/004* (2013.01); *A46B 2200/3033* (2013.01)

(58) Field of Classification Search

CPC . A46B 13/04; B08B 1/002; B08B 1/04; F21L 4/00

See application file for complete search history.

(56) References Cited

U.S. PATENT DOCUMENTS

| | | | | |
|---|---|---|---|---|
| 3,864,780 | A * | 2/1975 | Watkins | A46B 13/06 173/218 |
| 5,289,605 | A | 3/1994 | Armbruster | |
| 5,649,334 | A * | 7/1997 | Henriquez | B08B 1/04 15/97.1 |
| 6,170,108 | B1 * | 1/2001 | Knight | A46B 13/008 601/114 |
| 6,981,291 | B2 | 1/2006 | McKay | |
| 9,339,104 | B2 | 5/2016 | O'Neil | |
| 9,340,184 | B1 * | 5/2016 | Morris | B60S 3/048 |
| 9,579,250 | B2 * | 2/2017 | Nichols | A46B 13/008 |
| 9,681,782 | B2 * | 6/2017 | McCauley | A47K 7/043 |
| 10,806,320 | B1 * | 10/2020 | Welbourne | B08B 3/04 |
| 11,154,909 | B2 * | 10/2021 | Brennan | B08B 1/002 |
| 11,272,775 | B1 * | 3/2022 | Kizzee | A45D 34/04 |
| 2003/0177595 | A1 * | 9/2003 | Quach | B60S 3/048 15/29 |
| 2006/0168746 | A1 | 8/2006 | Guyuron | |
| 2006/0236474 | A1 | 10/2006 | Jaffe | |
| 2009/0188528 | A1 * | 7/2009 | Junkins | A46B 5/0095 15/28 |
| 2014/0099154 | A1 * | 4/2014 | O'Neill | A46B 5/0033 401/268 |
| 2017/0112333 | A1 | 4/2017 | McCauley | |

* cited by examiner

*Primary Examiner* — Zheng Song

(57) ABSTRACT

A powered scrubbing wand assembly for scrubbing a surface includes a handle that can be gripped during cleaning activities. A cleaning head is coupled to the handle and a drive unit is integrated into the handle. The drive unit rotates in a first direction when the drive unit is turned on. A spray unit is integrated into the handle for spraying a fluid soap when the spray unit is turned on. A plurality of scrubbers is each removably attachable to the cleaning head. The drive unit rotates the scrubber on the cleaning head when the drive unit is turned on thereby facilitating the scrubber to scrub a surface.

13 Claims, 5 Drawing Sheets

POWERED SCRUBBING WAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to scrubbing wand devices and more particularly pertains to a new scrubbing wand device for scrubbing a surface.

(2) Description of Related Art Including Information Disclosed Under 37 CFR 1.97 and 1.98

The prior art relates to scrubbing wand devices. The prior art discloses a scrubbing wand that includes a handle being pivotally coupled to cleaning head. Additionally, the prior art discloses a powered wand having a plurality of cleaning cylinders, each being removably coupled to an output of the powered wand and rotating about a longitudinal axis of the powered wand.

BRIEF SUMMARY OF THE INVENTION

An embodiment of the disclosure meets the needs presented above by generally comprising a handle that can be gripped during cleaning activities. A cleaning head is coupled to the handle and a drive unit is integrated into the handle. The drive unit rotates in a first direction when the drive unit is turned on. A spray unit is integrated into the handle for spraying a fluid soap when the spray unit is turned on. A plurality of scrubbers is each removably attachable to the cleaning head. The drive unit rotates the scrubber on the cleaning head when the drive unit is turned on thereby facilitating the scrubber to scrub a surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
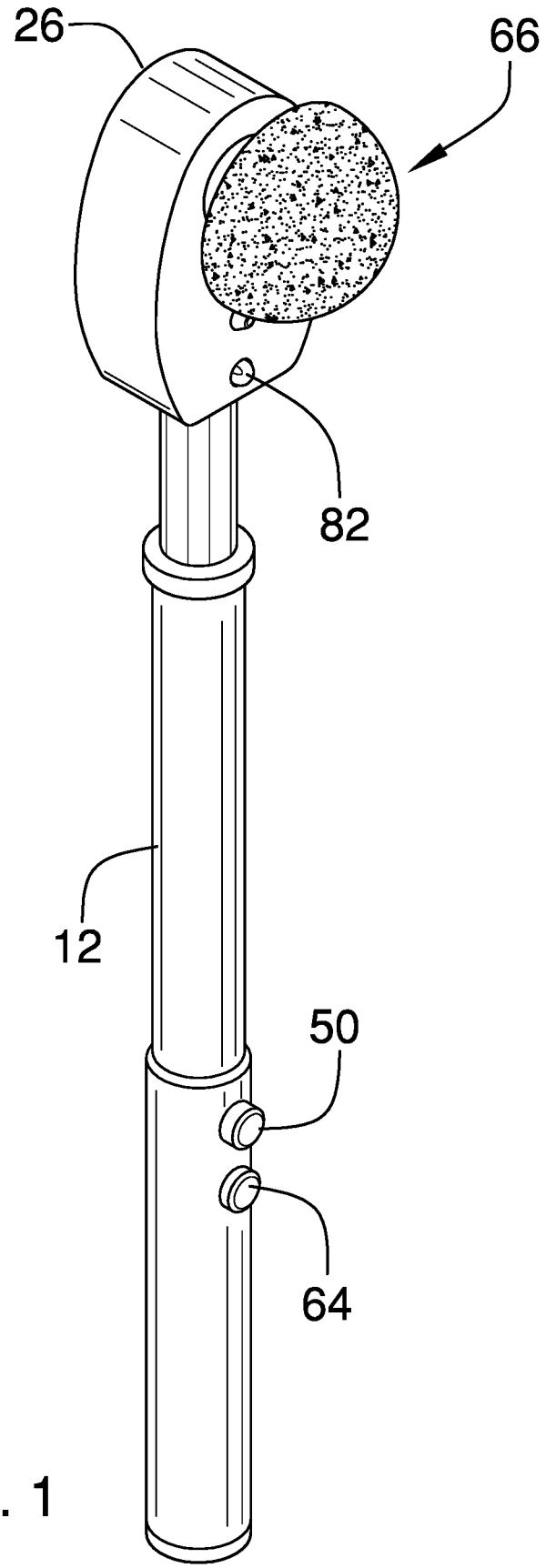
FIG. 1 is a front perspective view of a powered scrubbing wand assembly according to an embodiment of the disclosure.
Figure 2:
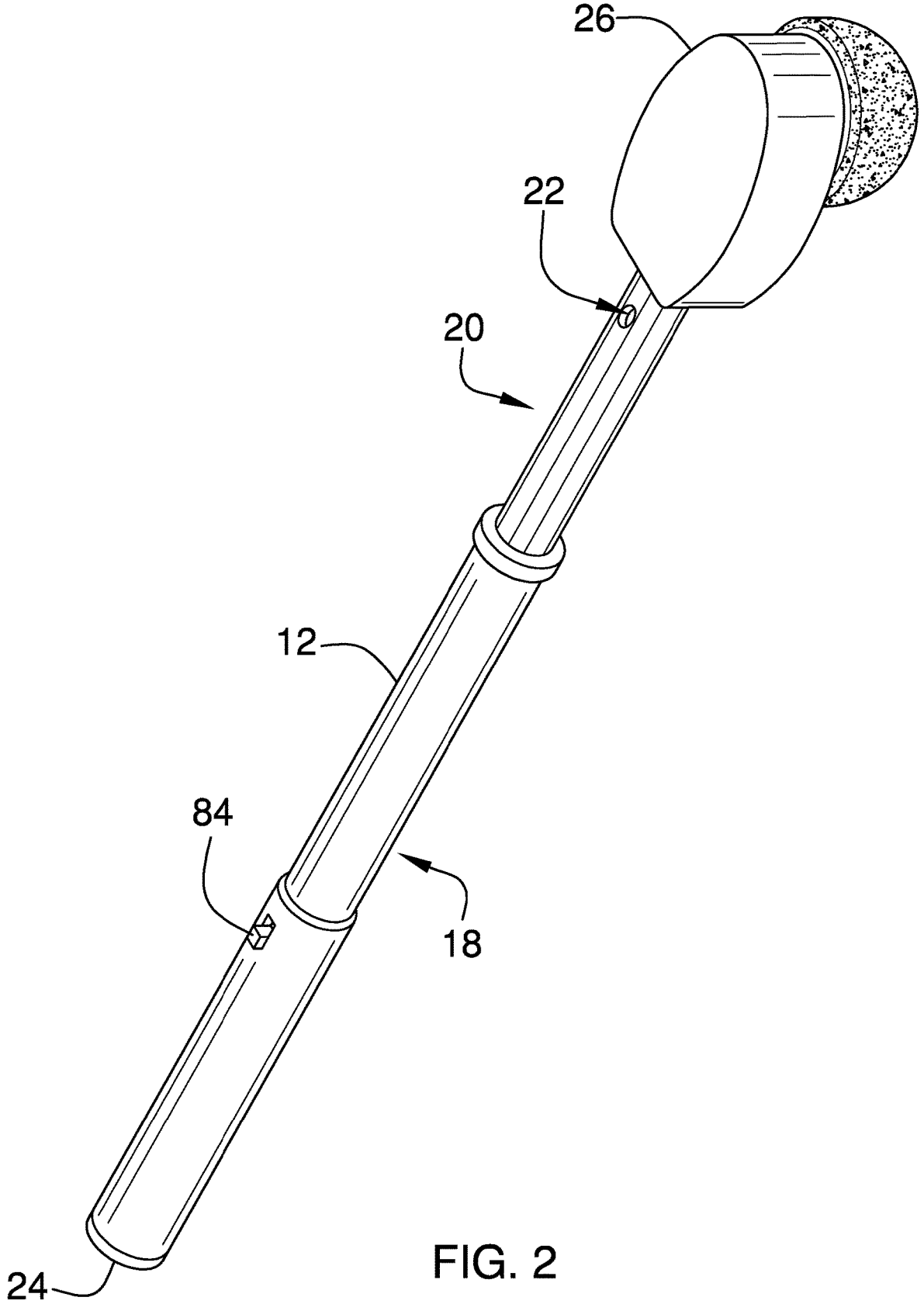
FIG. 2 is a back perspective view of an embodiment of the disclosure.
Figure 3:
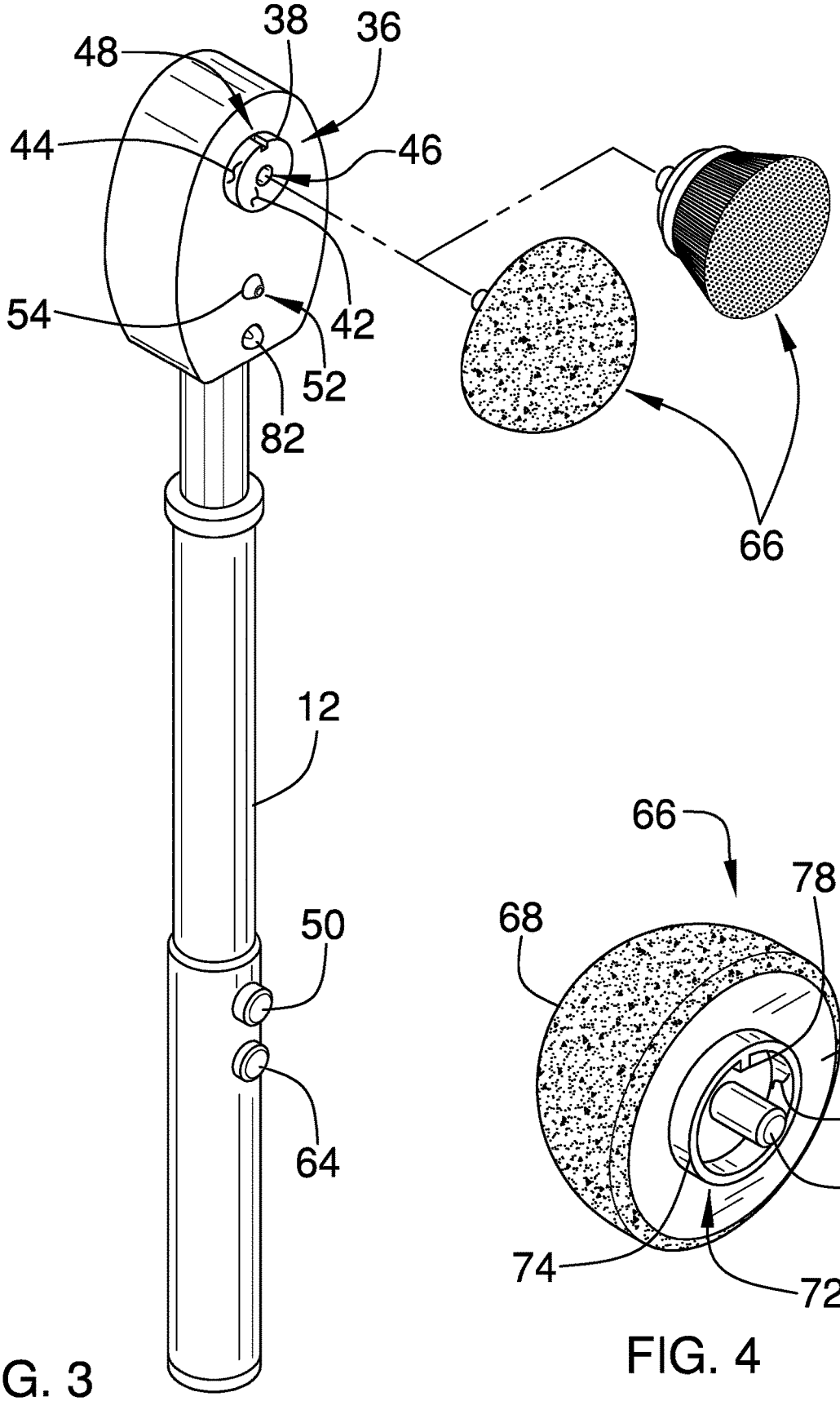
FIG. 3 is an exploded perspective view of an embodiment of the disclosure.
Figure 4:
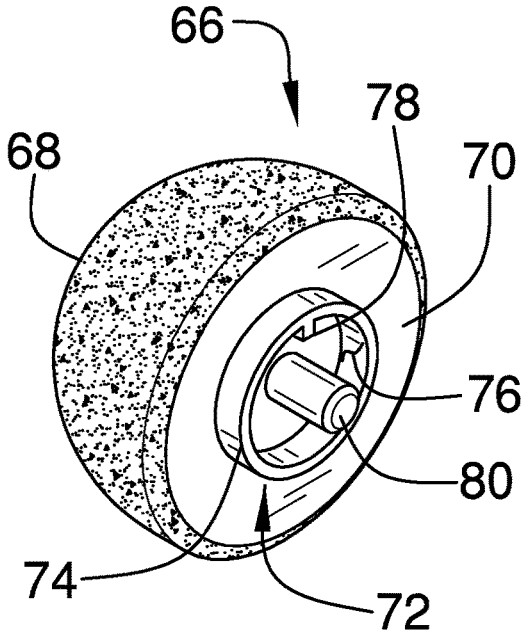
FIG. 4 is a perspective view of a scrubber of an embodiment of the disclosure.
Figure 5:
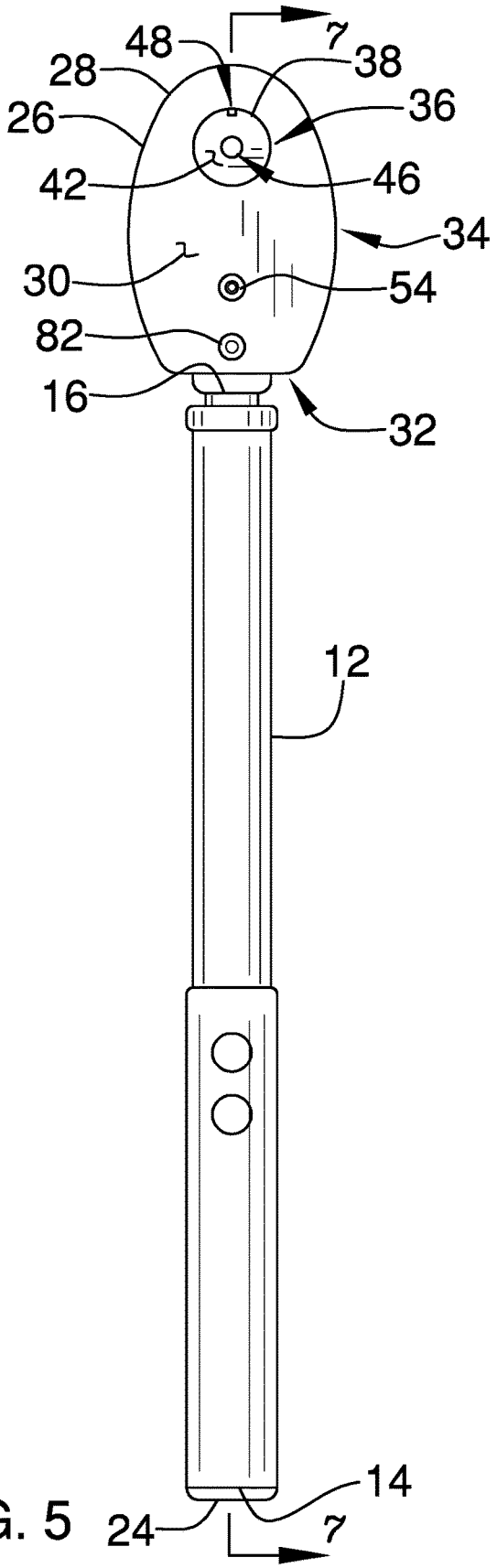
FIG. 5 is a front view of an embodiment of the disclosure.
Figure 6:
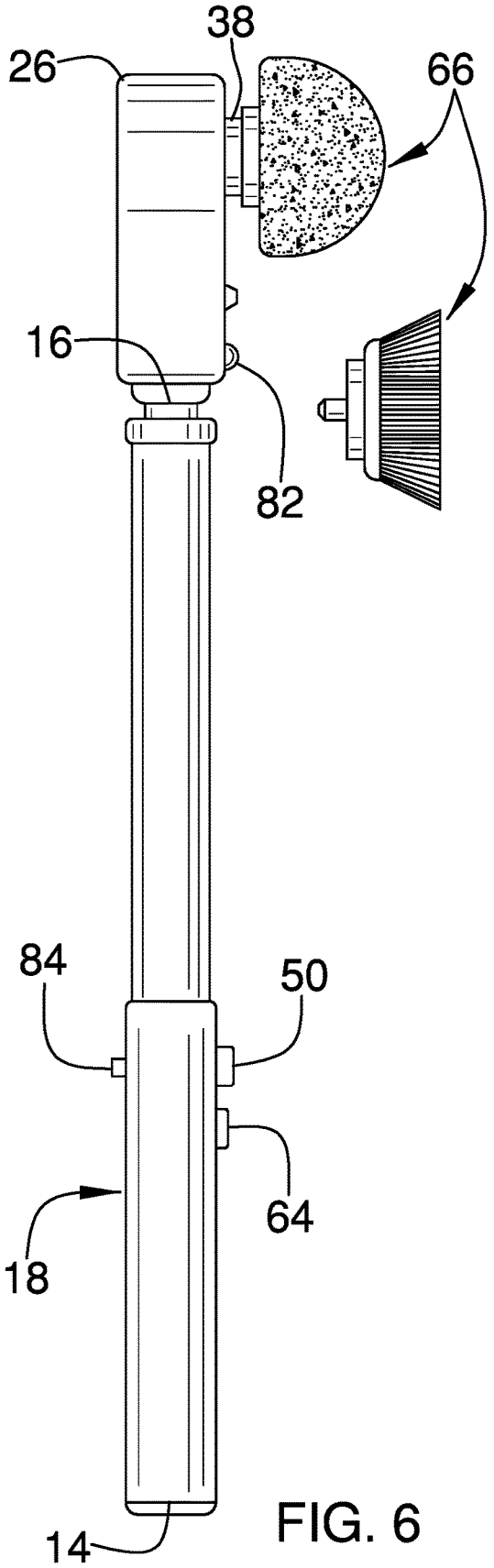
FIG. 6 is a right side view of an embodiment of the disclosure.
Figure 7:
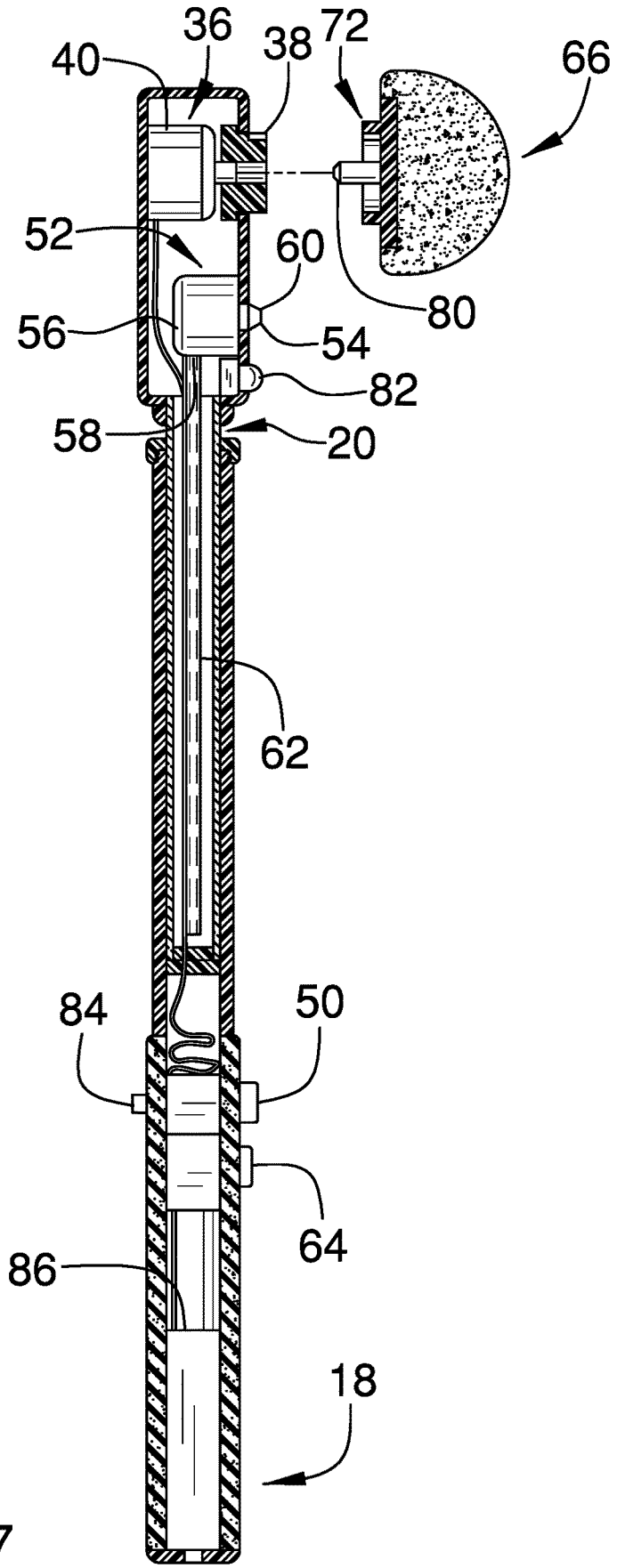
FIG. 7 is a cross sectional view taken along line 7-7 of FIG. 5 of an embodiment of the disclosure.

With reference now to the drawings, and in particular to FIGS. 1 through 7 thereof, a new scrubbing wand device embodying the principles and concepts of an embodiment of the disclosure and generally designated by the reference numeral 10 will be described.

As best illustrated in FIGS. 1 through 7, the powered scrubbing wand assembly 10 generally comprises a handle 12 that is gripped during cleaning activities. The handle 12 has a first end 14 and a second end 16, and the handle 12 comprises a first section 18 that slidably engages a second section 20 such that the handle 12 has a telescopically adjustable length. The handle 12 is hollow and the second section 20 is fluidly discrete from the first section 18 for containing a fluid soap. The second section 20 has a fill opening 22 extending into an interior of the second section 20 for filling the second section 20 with the fluid soap. The first end 14 is open and a cap 24 is removably coupled to the first end 14 of the handle 12 for closing the first end 14.

A cleaning head 26 is provided and the cleaning head 26 is coupled to the handle 12. The cleaning head 26 has an outer surface 28 and a front surface 30. The outer surface 28 has a flattened portion 32 and a rounded portion 34, and the flattened portion 32 is coupled to the second end 16 of the handle 12. A drive unit 36 is integrated into the handle 12 and the drive unit 36 rotates in a first direction when the drive unit 36 is turned on. The drive unit 36 has an output 38 that is positioned on the cleaning head 26.

The drive unit 36 comprises a motor 40 that is positioned in the cleaning head 26. The motor 40 rotates in a first direction when the motor 40 is turned on. The motor 40 may comprise an electric motor or the like. The output 38 has a forward surface 42 and a perimeter surface 44; the forward surface 42 has a well 46 extending inwardly therein and the perimeter surface 44 has a notch 48 therein. The output 38 is rotatably coupled to a drive shaft of the motor 40 such that the output 38 is spaced from the front surface 30 of the cleaning head 26. The drive unit 36 includes a clean button 50 that is positioned on the handle 12. The clean button 50 is electrically coupled to the motor 40 and the clean button 50 turns the motor 40 on and off.

A spray unit 52 is integrated into the handle 12 and the spray unit 52 is in fluid communication with the handle 12 to receive the fluid soap. The spray unit 52 includes a nozzle 54 extending away from the cleaning head 26. The nozzle 54 sprays the fluid soap when the spray unit 52 is turned on. The fluid soap may be a liquid detergent, such as dish soap or other detergent that is safe for use in the home.

The spray unit 52 comprises a pump 56 that is positioned within the cleaning head 26, and the pump 56 has an inlet 58 and an outlet 60. The nozzle 54 is positioned on the forward surface 42 of the cleaning head 26 and the nozzle 54 is fluidly coupled to the outlet 60 of the pump 56. The pump 56 may be an electric fluid pump or the like and the nozzle 54 may comprise an atomizer or other similar pressure increasing fitting. A tube 62 is fluidly coupled to the inlet of the pump 56 and the tube 62 extends into the second section 20 of the handle 12. In this way the tube 62 is submerged in the fluid soap. The pump 56 urges the fluid soap inwardly through the tube 62 and outwardly through the nozzle 54 when the pump 56 is turned on.

A spray button 64 is positioned on the handle 12, the spray button 64 is electrically coupled to the pump 56 and the spray button 64 turns the pump 56 on and off. A plurality of scrubbers 66 is provided and a selected one of the scrubbers 66 is removably attachable to the cleaning head 26. The drive unit 36 rotates the scrubber on the cleaning head 26 when the drive unit 36 is turned on thereby facilitating the scrubber to scrub a surface. Each of the scrubbers 66 is comprised of a unique material with respect to each other such that each of the scrubbers 66 has an associated degree of abrasion. Each of the scrubbers 66 has a forward side 68 and a rear side 70, and each of the scrubbers 66 includes a coupler 72 that is attached to the rear side 70. As is most clearly shown in FIG. 3, the plurality of scrubbers 66 may include, but not be limited to, a dome shaped sponge and a scrubbing brush.

The coupler 72 includes a ring 74 that is positioned on the rear side 70. The ring 74 has an inwardly facing surface 76 and the inwardly facing surface 76 has a key 78 thereon. The ring 74 surrounds the perimeter surface 44 of the output 38 having the key 78 engaging the notch 48 in the perimeter surface 44. In this way the ring 74 is retained on the ring 74 thereby facilitating the output 38 to rotate the ring 74. A pin 80 extends away from the rear side 70 and the pin 80 is centrally positioned in the ring 74. The pin 80 engages the well 46 in the forward surface 42 of the output 38.

A light emitter 82 is coupled to the cleaning head 26 to emit light outwardly therefrom and the light emitter 82 is positioned on the front surface 30 of the cleaning head 26. A light switch 84 is movably positioned on the handle 12, the light switch 84 is electrically coupled to the light emitter 82 and the light switch 84 turns the light emitter 82 on and off. A power supply 86 is positioned in the first section 18 of the handle 12. The power supply 86 is electrically coupled to the motor 40, the pump 56 and the light emitter 82, and the power supply 86 comprises at least one battery.

In use, the selected scrubber 66 is attached to the output 38 and the clean button 50 is depressed to turn on the motor 40. Thus, the scrubber 66 is rotated for scrubbing a surface, such as a bathroom sink, a counter top or any other surface that requires cleaning. The spray button 64 is manipulated to spray the fluid soap for enhancing scrubbing the surface. Additionally, the light switch 84 is manipulated to turn on the light emitter 82 for illuminating the surface while cleaning.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A powered scrubbing wand assembly being configured to rotate a scrubbing element for cleaning a surface, said assembly comprising:

a handle being gripped during cleaning activities, said handle comprising a first section that slidably engages a second section such that said handle has a telescopically adjustable length, said second section being fluidly discrete from said first section wherein said second section is configured to contain a fluid soap;

a cleaning head being coupled to said handle;

a drive unit being integrated into said handle, said drive unit rotating in a first direction when said drive unit is turned on, said drive unit having an output being positioned on said cleaning head;

a spray unit being integrated into said handle, said spray unit being in fluid communication with said handle wherein said spray unit is configured to receive the fluid soap, said spray unit including a nozzle extending away from said cleaning head, said nozzle spraying the fluid soap when said spray unit is turned on;

a plurality of scrubbers, each of said scrubbers being removably attachable to said cleaning head, said drive unit rotating said scrubber on said cleaning head when said drive unit is turned on thereby facilitating said scrubber to scrub a surface, each of said scrubbers being comprised of a unique material with respect to each other such that each of said scrubbers has an associated degree of abrasion; and a light emitter being coupled to said cleaning head wherein said light emitter is configured to emit light outwardly therefrom, said light emitter being positioned on said front surface of said cleaning head.

2. The assembly according to claim 1, wherein:

said handle has a first end and a second end, said handle being hollow, said second section having a fill opening extending into an interior of said second section for filling said second section with the fluid soap, said first end being open; and a cap being removably coupled to said first end of said handle for closing said first end.

3. The assembly according to claim 2, wherein said cleaning head has an outer surface and a front surface, said outer surface having a flattened portion and a rounded portion, said flattened portion being coupled to said second end of said handle.

4. The assembly according to claim 3, wherein said spray unit comprises a pump being positioned within said cleaning head, said pump having an inlet and an outlet, said nozzle being positioned on said forward surface of said cleaning head, said nozzle being fluidly coupled to said outlet of said pump.

5. The assembly according to claim 4, wherein said spray unit includes a tube being fluidly coupled to said inlet of said pump, said tube extending into said second section of said handle wherein said tube is configured to be submerged in the fluid soap, said pump urging the fluid soap inwardly through said tube and outwardly through said nozzle when said pump is turned on.

6. The assembly according to claim 5, further comprising a spray button being positioned on said handle, said spray button being electrically coupled to said pump, said spray button turning said pump on and off.

7. The assembly according to claim 6, wherein each of said scrubbers has a forward side and a rear side, each of said scrubbers including a coupler being attached to said rear side.

8. The assembly according to claim 7, wherein said coupler includes a ring being positioned on said rear side, said ring having an inwardly facing surface, said inwardly facing surface having a key thereon, said ring surrounding said perimeter surface of said output having said key engaging said notch in said perimeter surface thereby facilitating said output to rotate said ring.

9. The assembly according to claim 8, wherein said coupler includes a pin extending away from said rear side, said pin being centrally positioned in said ring, said pin engaging said well in said forward surface of said output.

10. The assembly according to claim 3, wherein said drive unit comprises a motor being positioned in said cleaning head, said motor rotating in a first direction when said motor is turned on.

11. The assembly according to claim 10, wherein said output has a forward surface and a perimeter surface, said output being rotatably coupled to a drive shaft of said motor such that said output is spaced from said front surface of said cleaning head, said forward surface having a well extending inwardly therein, said perimeter surface having a notch therein.

12. The assembly according to claim 11, further comprising a clean button being positioned on said handle, said clean button being electrically coupled to said motor, said clean button turning said motor on and off.

13. A powered scrubbing wand assembly being configured to rotate a scrubbing element for cleaning a surface, said assembly comprising:

a handle being gripped during cleaning activities, said handle having a first end and a second end, said handle comprising a first section that slidably engages a second section such that said handle has a telescopically adjustable length, said handle being hollow, said second section being fluidly discrete from said first section wherein said second section is configured to contain a fluid soap, said second section having a fill opening extending into an interior of said second section for filling said second section with the fluid soap, said first end being open;

a cap being removably coupled to said first end of said handle for closing said first end;

a cleaning head being coupled to said handle, said cleaning head having an outer surface and a front surface, said outer surface having a flattened portion and a rounded portion, said flattened portion being coupled to said second end of said handle;

a drive unit being integrated into said handle, said drive unit rotating in a first direction when said drive unit is turned on, said drive unit having an output being positioned on said cleaning head, said drive unit comprising:

a motor being positioned in said cleaning head, said motor rotating in a first direction when said motor is turned on, said output having a forward surface and a perimeter surface, said output being rotatably coupled to a drive shaft of said motor such that said output is spaced from said front surface of said cleaning head, said forward surface having a well extending inwardly therein, said perimeter surface having a notch therein; and a clean button being positioned on said handle, said clean button being electrically coupled to said motor, said clean button turning said motor on and off;

a spray unit being integrated into said handle, said spray unit being in fluid communication with said handle wherein said spray unit is configured to receive the fluid soap, said spray unit including a nozzle extending away from said cleaning head, said nozzle spraying the fluid soap when said spray unit is turned on, said spray unit comprising:

a pump being positioned within said cleaning head, said pump having an inlet and an outlet, said nozzle being positioned on said forward surface of said cleaning head, said nozzle being fluidly coupled to said outlet of said pump;

a tube being fluidly coupled to said inlet of said pump, said tube extending into said second section of said handle wherein said tube is configured to be submerged in the fluid soap, said pump urging the fluid soap inwardly through said tube and outwardly through said nozzle when said pump is turned on; and a spray button being positioned on said handle, said spray button being electrically coupled to said pump, said spray button turning said pump on and off;

a plurality of scrubbers, each of said scrubbers being removably attachable to said cleaning head, said drive unit rotating said scrubber on said cleaning head when said drive unit is turned on thereby facilitating said scrubber to scrub a surface, each of said scrubbers being comprised of a unique material with respect to each other such that each of said scrubbers has an associated degree of abrasion, each of said scrubbers having a forward side and a rear side, each of said scrubbers including a coupler being attached to said rear side, said coupler including:

a ring being positioned on said rear side, said ring having an inwardly facing surface, said inwardly facing surface having a key thereon, said ring surrounding said perimeter surface of said output having said key engaging said notch in said perimeter surface thereby facilitating said output to rotate said ring; and a pin extending away from said rear side, said pin being centrally positioned in said ring, said pin engaging said well in said forward surface of said output;

a light emitter being coupled to said cleaning head wherein said light emitter is configured to emit light outwardly therefrom, said light emitter being positioned on said front surface of said cleaning head;

a light switch being movably positioned on said handle, said light switch being electrically coupled to said light emitter, said light switch turning said light emitter on and off; and a power supply being positioned in said first section of said handle, said power supply being electrically coupled to said motor, said pump and said light emitter, said power supply comprising at least one battery.

* * * * *